US009227197B2

(12) United States Patent
Kim

(10) Patent No.: US 9,227,197 B2
(45) Date of Patent: Jan. 5, 2016

(54) SIMPLIFIED VALUABLE MINERAL SORTING APPARATUS AND METHOD OF SORTING VALUABLE MINERALS USING THE SAME

(71) Applicant: KOREA INSTITUTE OF GEOSCIENCE AND MINERAL RESOURCES, Daejeon (KR)

(72) Inventor: Hyeoncheol Kim, Daejeon (KR)

(73) Assignee: KOREA INSTITUTE OF GEOSCIENCE AND MINERAL RESOURCES, Daejeon (KR)

( * ) Notice: Subject to any disclaimer, the term of this patent is extended or adjusted under 35 U.S.C. 154(b) by 0 days.

(21) Appl. No.: 14/485,733

(22) Filed: Sep. 14, 2014

(65) Prior Publication Data

US 2015/0096924 A1 Apr. 9, 2015

(30) Foreign Application Priority Data

Oct. 4, 2013 (KR) ..... 10-2013-0118512

(51) Int. Cl.

| | |
|---|---|
| ***B07B 9/00*** | (2006.01) |
| ***B03B 5/36*** | (2006.01) |
| ***B03B 11/00*** | (2006.01) |
| ***B03B 13/00*** | (2006.01) |
| *B03B 5/40* | (2006.01) |

(52) U.S. Cl.

CPC . *B03B 5/36* (2013.01); *B03B 11/00* (2013.01); *B03B 13/00* (2013.01); *B03B 5/40* (2013.01)

(58) Field of Classification Search

CPC ..... B03B 5/36; B03B 5/40

USPC ..... 209/18, 172, 174

See application file for complete search history.

(56) References Cited

U.S. PATENT DOCUMENTS 6,662,951 B1 * 12/2003 Fellers ..... 209/158
7,255,233 B2 * 8/2007 Daniels et al. ..... 209/162

FOREIGN PATENT DOCUMENTS

| | | |
|---|---|---|
| JP | 06114294 | 4/1994 |
| JP | 06142546 | 5/1994 |
| JP | 07155510 | 6/1995 |
| KR | 101241789 | 3/2013 |
| KR | 101241790 | 3/2013 |

* cited by examiner

*Primary Examiner* — Howard Sanders

(74) *Attorney, Agent, or Firm* — Adam Warwick Bell; Matthew Rupert Kaser

(57) ABSTRACT

Disclosed herein is a simplified valuable mineral sorting apparatus including, a first storage tank which accommodates a mixture of water and heavy powder and includes a specific gravity measurement module; a second storage tank accommodating a portion of the mixture exceeding a capacity level line of the first storage tank; a first discharge tube which is connected to the first storage tank and the second storage tank to introduce the excess portion of the mixture into the second storage tank, and which is positioned at the capacity level line of the first storage tank; a second discharge tube which is connected to the first storage tank to discharge the mixture in the first storage tank and which includes a flow rate control module; a specific gravity sorting device which includes a sorting container for receiving the mixture discharged from the second discharge tube and which changes a slope of the sorting container to sort minerals from the mixture in the sorting container; and a control unit for controlling the flow rate control module and the specific gravity sorting device.

12 Claims, 9 Drawing Sheets

SIMPLIFIED VALUABLE MINERAL SORTING APPARATUS AND METHOD OF SORTING VALUABLE MINERALS USING THE SAME

RELATIONSHIP TO OTHER APPLICATIONS

The present application claims the benefit of and priority to Korean application No. 10-2013-0118512, filed 4 Oct. 2013 which application is fully incorporated by reference.

BACKGROUND OF THE INVENTION

1. Field of the Invention

The present invention relates generally to a mineral sorting apparatus and a method of operating the apparatus, and more particularly to a simplified valuable mineral sorting apparatus and a method of sorting minerals using the apparatus, which is configured to sort and collect various valuable minerals contained in clastic resources such as river sand or sea sand sediments.

2. Description of the Related Art

Valuable minerals such as ilmenite, rutile, zircon, sillimanite and monazite are used as essential elements in many kinds of industries. More specifically, ilmenite is used in production of welding rods, special magnetic materials or ultraviolet screening materials, and zircon is used in production of ceramics, high-class bearings or ball mills. Particularly, monazite usually contains a large of amount of rare elements such as lanthanum, cerium and samarium which are referred to as "vitamins of industry".

However, our country is importing the entirety of the above-mentioned minerals, and worldwide, the costs of raw mineral ores are currently rapidly on the rise, thereby causing the costs of the minerals to rise considerably. For example, rutile and sillimanite are approaching 200 dollars/ton, and zircon is approaching 900 dollars/ton. What is more, because countries possessing resources are weaponizing the resources in recent days, the countries possessing resources are seeking preventive measures against the outflow of their resources by strengthening their export regulation policies, such as raising export duties and restricting foreign-capital-funded resource development.

In contrast, because our country has almost no rare minerals present in ground reserves which are widely utilized in high-value-added industries, almost the total amount of the various necessary core materials and parts are imported from abroad. Thus our country may be seriously affected by the weaponization of resources and exclusive price increases of advanced countries and those countries possessing such resources. Accordingly, development of technologies for the extraction of domestic minerals is required, and thus there may be a rising interest in clastic resources such as sea sand and river sand.

The results of domestic exploration showed that sea sand or river sand contains valuable minerals such as ilmenite, monazite and zircon. For example, it was known that valuable minerals account for 1.5% of sea sand. Furthermore, data of the Construction Ministry from in 2007 showed that sea sand of 23 million tons is exploited and used as construction materials. There are about 500,000 tons of valuable minerals in 23,000,000 tons sea sand, and the economic value of these valuable minerals is approximately 1,000,000,000 dollars.

Accordingly, there is a need for a technology of preventing clastic resources such as sea sand and river sand from being mixed with construction aggregates and from being discarded, and of collecting valuable minerals such as rare minerals from clastic resources.

First of all, there is required for a technology which considers the facts that unlike mined mineral ores, clastic resources such as sand contains singulated minerals and that unlike a mineral ore containing a single kind of mineral, sand contains various kinds of valuable minerals.

The following documents may be relevant to the invention and are hereby fully incorporated by reference:

Korean Patent Registration No. 10-1241789
Korean Patent Registration No. 10-1241790
Japanese Patent document JP 06142546
Japanese Patent document JP 06114294
Japanese Patent document JP 07155510.

SUMMARY OF THE INVENTION

Accordingly, the present invention has been made keeping in mind the above problems occurring in the prior art, and an object of the present invention is to provide a simplified valuable mineral sorting apparatus and a method of sorting minerals using the apparatus which is capable of effectively and economically sorting valuable minerals contained in clastic resources such as sea sand or river sand.

In order to accomplish the above object, the present invention provides a simplified valuable mineral sorting apparatus which collects valuable minerals from clastic resources such as crushed rock powder, sea sand or river sand; the apparatus including: a first storage tank which accommodates therein a mixture composed of water and heavy powder and includes a specific gravity measurement module for measuring a specific gravity of the mixture; a second storage tank which is disposed below the first storage tank and which accommodates a portion of the mixture exceeding a capacity level line indicated on the first storage tank; a first discharge tube, an end of which passes through a bottom of the first storage tank and is connected to a upper part of the second storage tank such that the excess portion of the mixture is introduced into the second storage tank and the other end of which is positioned at the capacity level line indicated on the first storage tank and is adjustable in height; a second discharge tube which is connected to a side wall of the first storage tank to discharge the mixture in the first storage tank outside and which includes a flow rate control module for measuring and controlling a flow rate of the mixture; a specific gravity sorting device which includes therein a sorting container for receiving the mixture discharged from the second discharge tube and which changes a slope of the sorting container to sort one of a heavy mineral, a medium specific gravity mineral and a light mineral from the mixture in the sorting container; and a control unit for controlling operations of the flow rate control module and the specific gravity sorting device.

The specific gravity sorting device may include: a housing having an inverted trapezoidal (or other suitable configuration) section; a sorting container disposed at an upper part of the housing and receiving the mixture discharged through the second discharge tube; and a slope controller disposed in the housing to control a slope of the sorting container in response to a control signal from the control unit.

The slope controller may include: a rotating shaft coupled to a lower surface of the sorting container, the rotating shaft being coupled at an end thereof to the housing and at the other end thereof to a rotating gear; a rotating shaft control module for rotating the rotating shaft in response to a control signal from the control unit; and a communication module connected to the rotating shaft control module to communicate with the control unit, whereby the rotating shaft is rotated in response to the control signal from the control unit to change a slope of the sorting container within a range of 10~15°. Other slopes may be used in alternative embodiments from 2° to 45°, for example at least 5°, at least 10°, at least 20°, at least 30° or at least 40°.

The second discharge tube may include a flow rate control module for control a flow rate of the mixture discharged from the first storage tank, wherein the flow rate control module includes: a flow rate measuring sensor in which a reference flow rate value is set, and which measures a flow rate of the mixture in real time and outputs a corresponding signal when the measure flow rate data is above or under the reference flow rate value; an electronic flow rate control valve for controlling a flow rate of the mixture discharged from the second discharge tube in response to a control signal output from the control unit; and a communication module which sends a signal output from the flow rate measuring sensor to the control unit and receives a control signal output from the control unit.

The specific gravity measurement module may measure a specific gravity of the mixture distributed between a point of the first storage tank where the second discharge tube is connected and the capacity level line.

The specific gravity measurement module may include: a specific gravity measuring sensor for measuring a specific gravity of the mixture; and a communication module for outputting the measured specific gravity to the control unit.

Each of the first and second storage tanks may have an inclined bottom surface for the convenient washing thereof and an outlet provided at a lower part of the bottom thereof.

The simplified valuable mineral sorting apparatus may further include: a support frame for securing positions of the first and second storage tanks, wherein the support frame includes detachable inward flanges which come into contact with the first and second storage tanks.

The simplified valuable mineral sorting apparatus may further include: a flow path tube which is connected at an end thereof to the second storage tank and at the other end thereof to the first storage tank so as to allowing the mixture in the second storage tank to be supplied to the first storage tank, wherein the flow path tube includes detachable caps provided at the opposite ends thereof so as to enable the flow path tube to be detachably coupled to the first and second storage tanks.

In order to accomplish the above object, the present invention further provides a method of sorting valuable mineral using the apparatus disclosed above including: providing a mixture prepared by water and heavy powder into the first storage tank; providing a proper amount (about 100 g/dose) of clastic resource including crushed rock powder, sea sand or river sand into the sorting container; and sorting one of a heavy mineral, a medium specific gravity mineral and a light mineral from the clastic resource in the sorting container by controlling a slope of the sorting container depending on a specific gravity of the mixture and a flow rate of the discharged mixture.

The method may further include: supplying a portion of the mixture which exceeds a predetermined capacity level of the first storage container and resupplying the portion of the mixture to the first storage tank again by means of a lifting pump.

Sorting the mineral may include: measuring a specific gravity of the mixture upon discharging the mixture from the first storage tank; measuring a flow rate of the discharged mixture; controlling a flow rate of the discharged mixture; and sorting one of a heavy mineral, a medium specific gravity mineral and a light mineral from the mixture in the sorting container.

According to present invention, the simplified valuable mineral sorting apparatus has a small size and thus facilitates its installation and transport. Furthermore, since the apparatus recirculates a mixture used in sorting minerals, it does not need additional installation of water and wastewater equipment. Accordingly, the apparatus enables valuable minerals such as rare minerals to be economically and effectively sorted and collected from clastic resources such as crushed rock powder, sea sand and river sand, thus allowing the kind and an approximate amount of valuable minerals to be determined.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Exemplary embodiments of the present invention will be described more fully hereinafter with reference to the accompanying drawings. In the following description of the present invention, detailed descriptions of known functions and components incorporated herein will be omitted when it may make the subject matter of the present invention unclear.

Reference will now be made in detail to various embodiments of the present invention, specific examples of which are illustrated in the accompanying drawings and described below, since the embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between," "directly between," "adjacent to," or "directly adjacent to," should be construed in the same way.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Hereinafter, a simplified valuable mineral sorting apparatus according to an embodiment of the present invention will be described.

Figure 1:
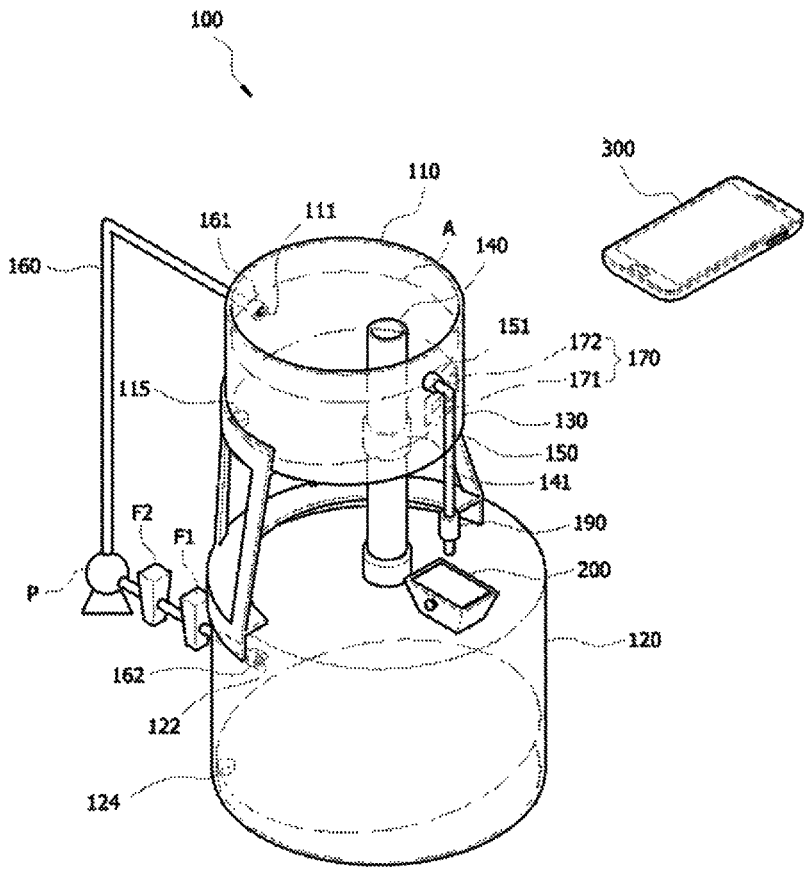
FIG. 1 is a perspective view of the simplified valuable mineral sorting apparatus according to the present invention.
Figure 2:
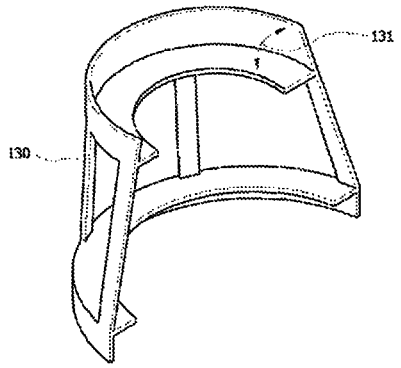
FIG. 2 is an enlarged view of a support frame shown in FIG. 1.
Figure 3:
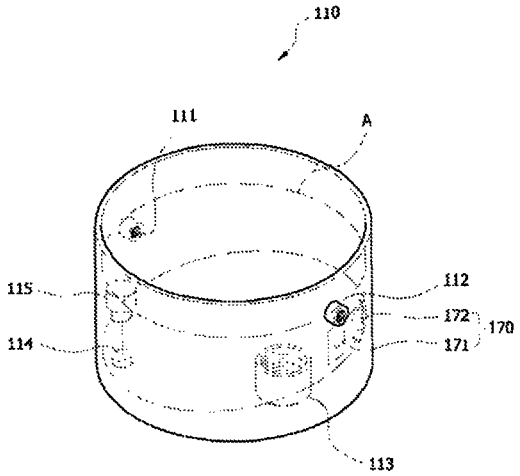
FIG. 3 is a perspective view of a first storage tank shown in FIG. 1.
Figure 4:
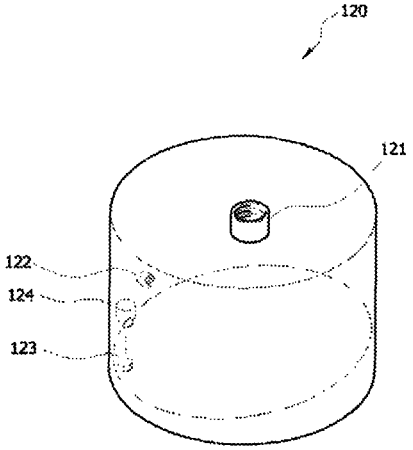
FIG. 4 is a perspective view of a second storage tank shown in FIG. 1/
Figure 5:
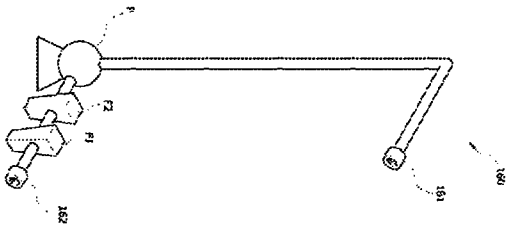
FIG. 5 is a perspective view of a flow path tube shown in FIG. 1.
Figure 6:
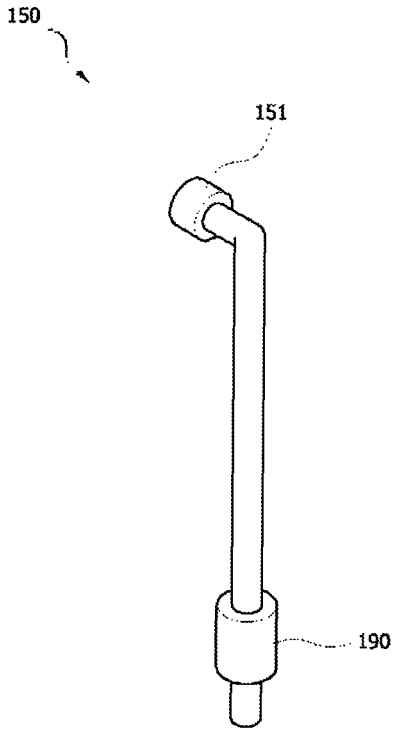
FIG. 6 is a perspective view of a second discharge tube shown in FIG. 1.
Figure 7:
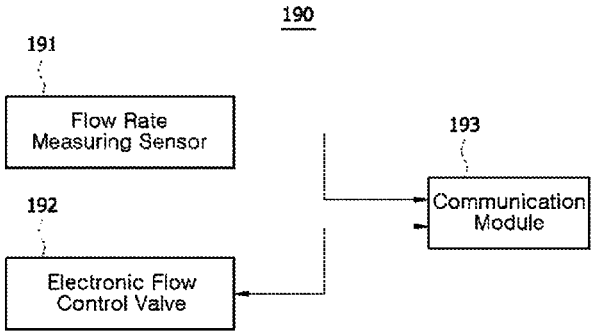
FIG. 7 is a block diagram of a flow rate control module shown in FIG. 6/
Figure 8:
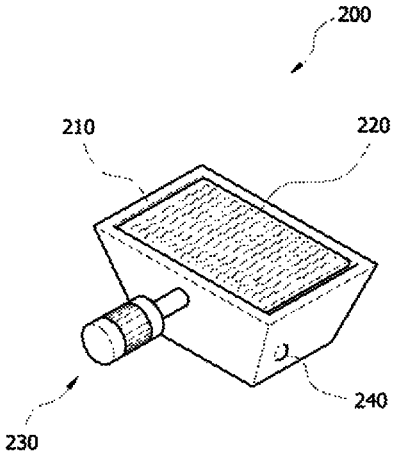
FIG. 8 is a perspective view of a gravity sorting device shown in FIG. 1.
Figure 9:
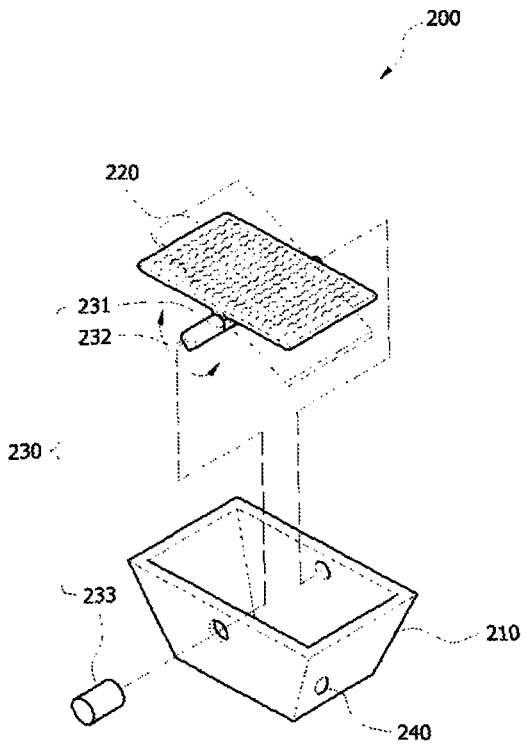
FIG. 9 is an exploded perspective view of the gravity sorting device shown in FIG. 8.

FIG. 1 is a perspective view of the simplified valuable mineral sorting apparatus according to the present invention, FIG. 2 is an enlarged view of a support frame shown in FIG. 1, FIG. 3 is a perspective view of a first storage tank shown in FIG. 1, FIG. 4 is a perspective view of a second storage tank shown in FIG. 1, FIG. 5 is a perspective view of a flow path tube shown in FIG. 1, FIG. 6 is a perspective view of a second discharge tube shown in FIG. 1, FIG. 7 is a block diagram of a flow rate control module shown in FIG. 6, FIG. 8 is a perspective view of a gravity sorting device shown in FIG. 1, and FIG. 9 is an exploded perspective view of the gravity sorting device shown in FIG. 8.

As illustrated in FIG. 1, the simplified valuable mineral sorting apparatus 100 according to the present invention comprises a first storage tank 110, a second storage tank 120, a first discharge tube 140, a second discharge tube 150, a flow path tube 160, a specific gravity sorting device 200 and a control unit 300.

The simplified valuable mineral sorting apparatus 100 further comprises a support frame 130 which is configured to secure positions of the first and second storage tanks 110, 120.

The first storage tank 110 may be composed of a cylinder having an open top so as to accommodate a mixture prepared by mixing water and heavy powder.

More specifically, as illustrated in FIG. 3, the first storage tank 110 is composed of a cylinder having an open top, a first flow faucet 111 which protrudes outward is formed at a location on an outer surface of the cylinder, and a second flow faucet 112 which also protrudes outward is formed at another location on the outer surface of the cylinder.

The first protruding flow faucet 111 is coupled to an end of the flow path tube 160 in a screwing manner, and the second protruding flow faucet 112 is coupled to an end of the second discharge tube 150 in a screwing manner.

The bottom surface of the first storage tank 110 is inclined, and a first outlet 114 is provided at a lower part of the bottom surface of the first storage tank 110. The first outlet 114 is used to discharge the washed contents during washing of the first storage tank 110. Meanwhile, when the first storage tank 110 is not washed, the first outlet 114 is clogged with a sealing member 115.

The bottom of the first storage tank 110 is further provided with a third flow faucet 113 which is used when the first discharge tube 140 is drawn in the first storage tank 110.

The first storage tank 110 is provided on an inner surface thereof with a specific gravity measurement module 170 which is used in measuring the specific gravity of the mixture between a point where the second discharge tube 150 is connected and a predetermined capacity level line. The specific gravity measurement module 170 includes a specific gravity measuring sensor 171 for measuring a specific gravity of the mixture, for example, the mixture introduced from the second discharge tube 150, and a communication module 172 for transmitting the specific gravity value output from the specific gravity measuring sensor 171 to the control unit 300.

Referring to FIG. 4, the second storage tank 120 is disposed below the first storage tank 110, and is adapted to accommodate the portion of the mixture which exceeds the predetermined capacity level of the first storage tank 110 and is discharged through the second discharge tube 150 and the specific gravity sorting device 200.

More specifically, the second storage tank 120 is also composed of a cylinder. The top surface of the second storage tank 120 is provided with a fourth flow faucet 121 which is connected to an end of the first discharge tube 140.

The second storage tank 120 is further provided at an outer surface thereof with a fifth flow faucet 122 which is connected to the other end of the flow path tube 160.

The bottom of the second storage tank 120 is constructed to have the same configuration as that of the first storage tank 110. A second outlet 123 is provided at a lower part of the bottom surface of the second storage tank 120. The second outlet 123 is used to discharge the washed contents during washing of the second storage tank 120. Meanwhile, when the second storage tank 120 is not washed, the second outlet 123 is clogged with a sealing member 124.

In this context, the flow path tube 160 is connected at an end thereof to the first storage tank 110 and at the other end thereof to the second storage tank 120, and functions to allow the mixture in the second storage tank 120 to be supplied into the first storage tank 110 by a lifting pump. The flow path tube 160 may include a first filter F1 and a second filter (F2). The first and second filters F1, F2 function to separate samples contained in the mixture (for example, crushed rock powder, sea sand, river sand and the like).

This is because the mixture which is introduced in the first storage tank 110 must be always composed of water and heavy powder.

In other words, the flow path tube 160 is provided with at least two filters such that there is no contamination caused by samples which have been separated previously even though the kinds of the samples are changed.

In this context, the first filter F1 serves as a subsidiary filter, and the second filter F2 serves as a primary filter. The first and second filters F1, F2 may be of the same kind, and are designed to filter particles of about 5 mm or more in size. The filters F1, F2 which are disclosed in the description are only illustrative, and are not limited thereto and may be changed depending on the kinds of samples.

An end of the first discharge tube 140 passes through the bottom of the first storage tank 110 and is connected to the top of the second storage tank 120. The other end of the first storage tube 140 is positioned at a capacity level line A which is indicated on the first storage tank 110. Consequently, the portion of the mixture which exceeds the capacity level line A is introduced into the first discharge tube 140 and then the second storage tank 120.

A height of the first discharge tube 140 can be adjusted and thus a pressure of the mixture which is introduced into the second discharge tube 150 can be adjusted by controlling the level of the mixture contained in the first storage tank 110.

Referring to FIG. 6, the second discharge tube 150 is connected to the second protruding flow faucet 112 of the first storage tank 110 so that the mixture in the first storage tank 110 is discharged through the second discharge tube 150. In this context, the second flow faucet 112 may be positioned at a middle height or lower height of an outer surface of the first storage tank 110 such that the mixture can be discharged from the first storage tank 110.

At this point, the first protruding flow faucet 111 and the fifth protruding flow faucet 122 are externally threaded, and the opposite ends of each of the first discharge tube 140, the second discharge tube 150 and the flow path tube 160 are provided with detachable caps which are detachably coupled to the opposite ends in a screwing manner and are thus easily coupled to the flow faucets in a detachable manner.

In other words, the detachable cap 141 of the first discharge tube 140 is detachably coupled to the third protruding flow faucet 113 and the fourth protruding flow facet 121. The detachable cap 151 of the second discharge tube 150 is detachably coupled to the second protruding flow facet 112, and the detachable caps 161, 162 of the flow path tube 160 are detachably coupled to the first protruding flow facet 111 and the fifth protruding flow facet 122.

Meanwhile, a distance between the capacity level line A and the second protruding flow facet 112 is associated with a flow velocity of mixture discharged from the second discharge tube 150.

The second discharge tube 150 further includes a flow rate control module 190 for measuring and controlling a flow rate of the mixture discharged from the first storage tank 110, thus controlling the flow rate of the discharged mixture.

More specifically, referring to FIG. 1, the flow rate control module 190 comprises a flow rate measuring sensor 191, an electronic flow rate control valve 192 and a communication module 193 in order to perform the control of flow rate of the mixture discharged from the first storage tank 110.

A reference flow rate value is set in the flow rate measuring sensor 191, and a flow rate of the mixture is measured in real time. When the measured flow rate value is the same as or smaller than the reference flow rate value, the flow rate measuring sensor 191 functions to output a signal corresponding to the condition.

The electronic flow control valve 192 functions to control a flow rate of the mixture discharged from the second discharge tube 150 in response to the control signal sent from the control unit 300.

The communication module 193 functions to: send the signal output from the flow rate measuring sensor 191, receive the control signal transmitted from the control unit 300, and send the control signal to the electronic flow rate control valve 192.

The control unit 300 controls the electronic flow rate control valve 192 in response to reception of the overflow signal, thus causing a flow rate of the discharged mixture to be adjusted to the reference flow rate value. In this context, the reference flow rate value is previously determined based on heavy minerals among valuable minerals, and may be, for example, 0.1 l/sec with an allowable range of ±0.05/sec.

Referring to FIG. 2, the support frame 130 functions to hold the first storage tank 110 and the second storage tank 120 in place. More specifically, the support frame 130 is detachably coupled to a lower part of the first storage tank 110 and an upper part of the second storage tank 120 using fastening elements.

Referring to FIGS. 8 and 9, the specific gravity sorting device 200 functions to accommodate the mixture discharged through the second discharge tube 150 and to change a slope of a sorting container 220 and a flow rate of the mixture discharged from the second discharge tube 150 so as to sort one of a heavy mineral, a medium specific gravity mineral and a light mineral depending on its specific gravity.

More specifically, the specific gravity sorting device 200 comprises a housing 210, the sorting container 220, and a slope controller 230.

The housing 210 is configured to have an inverted trapezoidal section, and is fixed to the top surface of the second storage tank 120.

The sorting container 220 is disposed on the top of the housing 210 and is provided on an upper surface thereof with a plurality of linear protrusions. The sorting container 220 is used in sorting one of a heavy mineral, a medium specific gravity mineral and a light mineral in the sorting container 220 based on a specific gravity and a flow rate of the mixture discharged through the second discharge tube 150.

More specifically, the mixture discharged through the second discharge tube 150 falls on an end of the sorting container 220, and the fallen mixture is introduced into the sorting container 220 thus filling the sorting container 220 with the mixture. At this point, a portion of the mixture which exceeds the capacity of the sorting container 220 overflows at the other inclined end of the sorting container 220. At this time, one of a heavy mineral, a medium specific gravity mineral and a light mineral is sorted at the other end of the sorting container 220 depending on an inclined angle of the sorting container 220.

The slope controller 230 functions to control a slope of the sorting container 220 within a range of 0~15°, preferably within a range of 10~15°.

More specifically, the slope controller 230 is provided on a lateral surface of the housing 210, and includes a rotating shaft 231, a rotating shaft control module 232 and a communication module 233.

The rotating shaft 231 is coupled at an end thereof to the housing 210, and is provided at the other end thereof with a rotating gear. The rotating shaft control module 232 functions to rotate the rotating shaft 231 by means of the control unit 300.

The communication module 233 functions to receive a wireless control signal transmitted from the control unit 300 and to send the signal to the rotating control module 232. At this point, the rotating shaft control module 232 may be a wireless control electric motor.

For reference, mineral sorting processes which utilize difference in specific gravity may include a specific gravity sorting process, an oil film sorting process and a jig sorting process. Among these processes, the specific gravity sorting apparatus 200 according to the present invention adopts the specific gravity sorting process of sorting solid particles by means of differences in specific gravity in which a fluid having a specific gravity higher than 1 is used and minerals are sorted into a light mineral, being lighter than the fluid and a heavy mineral, being heavier than the fluid.

In this context, the specific gravity sorting process has to be subjected to a settling theory of particles in fluid and an equal settling ratio is critical to this process. An equal settling ratio refers to a ratio of different particles when heavy particles, having a higher specific gravity and a smaller size; and lighter particles, having a lower specific gravity and a larger size have the same settling velocity when both the heavy and light particles, each having the appropriate size and specific gravity, respectively.

The flow path tube 160 is connected to an outer surface of the first storage tank 110 and an outer surface of the second storage tank 120 so as to resupply the mixture introduced in the second storage 120 to the first storage tank 110. Furthermore, the flow path tube 160 may be connected to a fluid pump so as to resupply the mixture in the second storage tank 120 to the first storage tank 110. The fluid pump is adapted to supply the mixture in the second storage tank 120 to the first storage tank 110 at a flow velocity of 0.2 l/sec.

The control unit 300 includes a memory (not shown) in which an application program is stored to control the flow rate control module 190 and the slope controller 230 in a wireless manner.

The memory (not shown) may include at least one memory medium of a flash memory type memory, a hard disk type memory, a multimedia card micro type memory, a card type memory (for example, SD memory or XD memory), RAMs (Random Access Memory), SRAM (Static Random Access Memory), ROMs (ReadOnly Memory), EEPROMs (Electrically Erasable Programmable ReadOnly Memory), PROMs (Programmable ReadOnly Memory), a magnetic memory, a magnetic disk, and an optical disk.

The control unit 300 is a portable electric and electronic appliance referring to any kind of hand-held wireless communication device which includes: portable equipment having a communication function such as a PDC (Personal Digital Cellular) phone, a PCS (Personal Communication Service) phone, a PHS (Personal Handyphone System) phone, a CDMA-2000 (1X, 3X) phone, a WCDMA (Wideband CDMA) phone, a Dual Band/Dual Mode phone, a GSM (Global Standard for Mobile) phone, an MBS (Mobile Broadband System) phone, a DMB (Digital Multimedia Broadcasting) phone, a Smart phone, and a cellular telephone; a mobile computer such as a PDA (Personal Digital Assistant), a Hand-Held PC, a notebook computer, a laptop computer, a WiBro terminal, an MP3 player and an MD player; and an IMT-2000 (International Mobile Telecommunication-2000) terminal which provides an international roaming service and a broadened mobile communication service, all of which are equipped with the memory. The control unit 300 is construed as referring to a terminal which may include: a CDMA (Code Division Multiplexing Access) module, a Bluetooth module, an Infrared Data Association, a wire and wireless LAN card or any communication module equipped with any communication module, such as a wireless communication device equipped with a GPS chip, so as to allow tracking of a position through a GPS (Global Positioning System) and which can carry out a certain arithmetic processing by means of a microprocessor incorporated therein.

Figure 10:
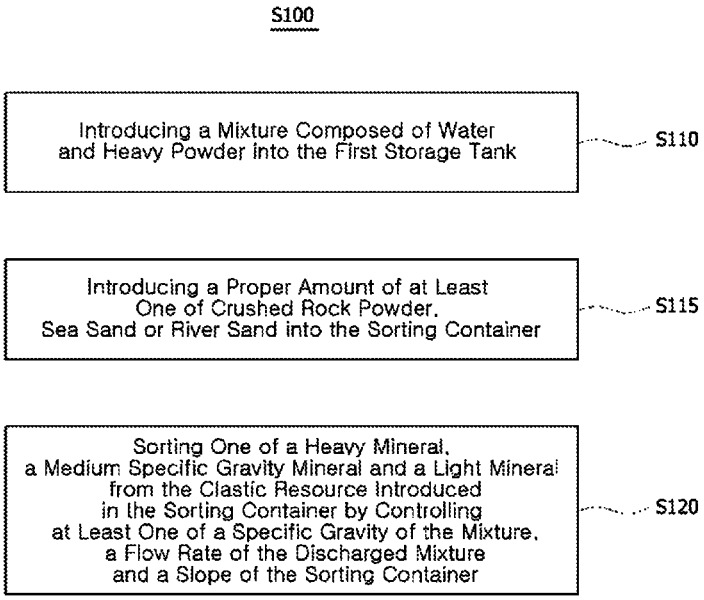
FIG. 10 is a flowchart illustrating a sorting process using the simplified valuable mineral sorting apparatus shown in FIG. 1, according to the present invention.
Figure 11:
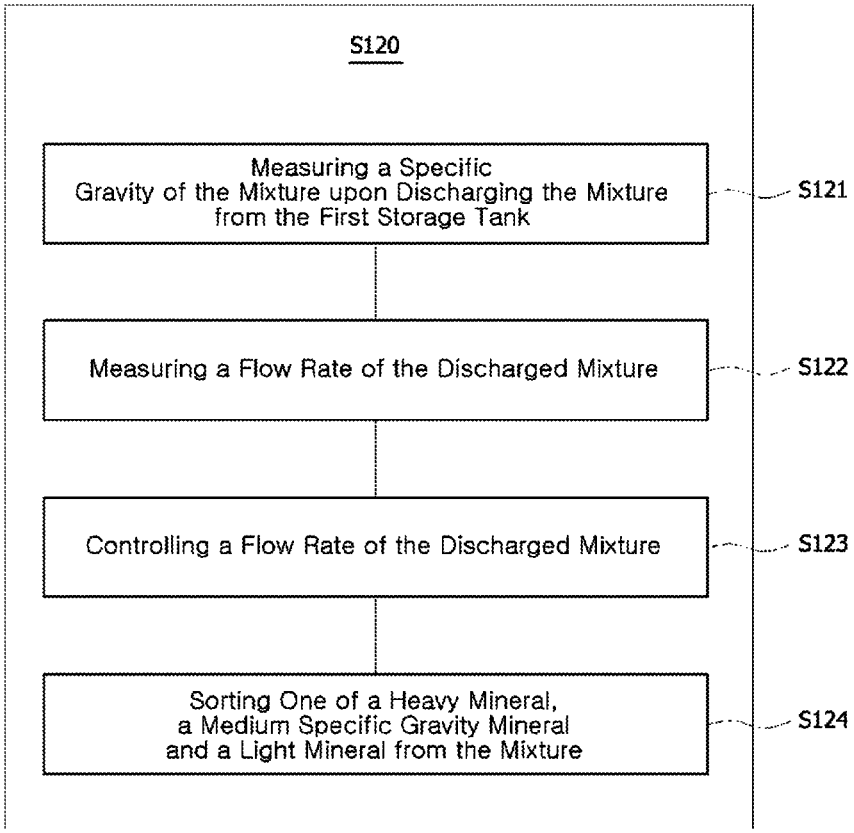
FIG. 11 is a flowchart specifically illustrating Step S120 shown FIG. 10.

FIG. 10 is a flowchart illustrating a sorting process using the simplified valuable mineral sorting apparatus shown in FIG. 1, according to the present invention, and FIG. 11 is a flowchart specifically illustrating Step S120 shown FIG. 10.

As illustrated in FIG. 10, the valuable mineral sorting method (S100) according to an embodiment of the present invention comprises Step (S110) of providing a mixture, Step (S115) of providing clastic resource, and step (S120) of sorting minerals.

Step (S110) of providing a mixture may be fulfilled by introducing a mixture composed of water and heavy powder into the first storage tank 110.

Step (S115) of providing clastic resource may be fulfilled by introducing a proper amount (about 100 g/dose) of clastic resource including crushed rock powder, sea sand or river sand into the sorting container 220.

Step (S120) of sorting minerals may be fulfilled by sorting one of a heavy mineral, a medium specific gravity mineral and a light mineral from the clastic resource introduced in the sorting container 220 by controlling at least one of a specific gravity of the mixture, a flow rate of the discharged mixture and a slope of the sorting container 220.

The valuable mineral sorting method (S100) may further include a step of supplying a portion of the mixture which exceeds a predetermined capacity level of the first storage container 110 and resupplying the portion of the mixture to the first storage tank 110 again by means of a lifting pump P after the Step (S120) of sorting minerals.

As illustrated in FIG. 11, Step (S120) of sorting minerals may include a first step (S121) to a fourth step (S124).

The first step (S121) may be fulfilled by measuring a specific gravity of the mixture by means of the specific gravity measuring sensor 171 upon discharging the mixture from the first storage tank 110.

When the specific gravity measuring sensor 171 measures a specific gravity of the mixture in the first storage tank 110 in real time and sends the measured specific gravity data the control unit 300 through the communication module, a user can check the specific gravity of the mixture in real time by means of the control unit 300. The specific gravity of the mixture may vary depending on the kind of the required mineral.

The second step (S122) may be fulfilled by measuring a flow rate of the discharged mixture. A reference flow rate value is set in the flow rate measuring sensor 191. When a measured flow rate value is above or under the reference flow rate value, a processing signal corresponding to the condition is transmitted to the control unit 300.

The third step (S123) may be fulfilled in such a way that the control unit 300 controls the electronic flow control valve 192 and thus a flow rate of the discharged mixture based on the flow rate data detected by the flow rate measuring sensor 191.

The fourth step (S124) is intended to sort one of a heavy mineral, a medium specific gravity mineral and a light mineral from the mixture in the sorting container 220. At this point, the control unit 300 controls the rotating shaft 231 of the slope controller 230 and thus a slope of the sorting container 220 depending on the required mineral. The slope of the sorting container 220 may vary depending on a specific gravity of the mixture or a flow rate of the discharged mixture.

After the first step (S121), when the specific gravity of the mixture is under the desired value, a step of adding heavy powder to the first storage tank 110 to control the specific gravity of the mixture to the predetermined value may be further provided.

Accordingly, the simplified valuable mineral sorting apparatus 100 according to the present invention has a lot of advantages in that it does not need installation of water and wastewater equipment, installation thereof is facilitated owing to the reduced size, and it enables valuable minerals such as rare minerals to be economically and effectively sorted and collected from clastic resources such as crushed rock powder, sea sand and river sand.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, it is to be understood that the invention is not limited to the specific embodiments thereof except as defined in the appended claims.

What is claimed is:

1. A simplified valuable mineral sorting apparatus which collects valuable minerals from clastic resources such as crushed rock powder, sea sand or river sand, the apparatus comprising:

a first storage tank which accommodates therein a mixture composed of water and heavy powder and includes a specific gravity measurement module for measuring a specific gravity of the mixture;

a second storage tank which is disposed below the first storage tank and which accommodates a portion of the mixture exceeding a capacity level line indicated on the first storage tank;

a first discharge tube, an end of which passes through a bottom of the first storage tank and is connected to a upper part of the second storage tank such that the excess portion of the mixture is introduced into the second storage tank and the other end of which is positioned at the capacity level line indicated on the first storage tank and is adjustable in height;

a second discharge tube which is connected to a side wall of the first storage tank to discharge the mixture in the first storage tank outside and which includes a flow rate control module for measuring and controlling a flow rate of the mixture;

a specific gravity sorting device which includes therein a sorting container for receiving the mixture discharged from the second discharge tube and which changes a slope of the sorting container to sort one of a heavy mineral, a medium specific gravity mineral and a light mineral from the mixture in the sorting container; and a control unit for controlling operations of the flow rate control module and the specific gravity sorting device.

2. The simplified valuable mineral sorting apparatus according to claim 1, wherein the specific gravity sorting device comprises:

a housing having an inverted trapezoidal section;

the sorting container disposed at an upper part of the housing and receiving the mixture discharged through the second discharge tube; and a slope controller disposed in the housing to control a slope of the sorting container in response to a control signal from the control unit.

3. The simplified valuable mineral sorting apparatus according to claim 2, wherein the slope controller comprises:

a rotating shaft coupled to a lower surface of the sorting container, the rotating shaft being coupled at an end thereof to the housing and at the other end thereof to a rotating gear;

a rotating shaft control module for rotating the rotating shaft in response to a control signal from the control unit; and a communication module connected to the rotating shaft control module to communicate with the control unit, whereby the rotating shaft is rotated in response to the control signal from the control unit to change a slope of the sorting container within a range of 10~15°.

4. The simplified valuable mineral sorting apparatus according to claim 1, wherein the second discharge tube includes the flow rate control module for control a flow rate of the mixture discharged from the first storage tank, wherein the flow rate control module comprises:

a flow rate measuring sensor in which a reference flow rate value is set, and which measures a flow rate of the mixture in real time and outputs a corresponding signal when the measure flow rate data is above or under the reference flow rate value;

an electronic flow rate control valve for controlling a flow rate of the mixture discharged from the second discharge tube in response to a control signal output from the control unit; and a communication module which sends a signal output from the flow rate measuring sensor to the control unit and receives a control signal output from the control unit.

5. The simplified valuable mineral sorting apparatus according to claim 1, wherein the specific gravity measurement module measures a specific gravity of the mixture distributed between a point of the first storage tank where the second discharge tube is connected and the capacity level line.

6. The simplified valuable mineral sorting apparatus according to claim 5, wherein the specific gravity measurement module comprises:

a specific gravity measuring sensor for measuring a specific gravity of the mixture; and a communication module for outputting the measured specific gravity to the control unit.

7. The simplified valuable mineral sorting apparatus according to claim 1, wherein each of the first and second storage tanks has an inclined bottom surface for the convenient washing thereof and an outlet provided at a lower part of the bottom thereof.

8. The simplified valuable mineral sorting apparatus according to claim 1, further comprising: a support frame for securing positions of the first and second storage tanks, wherein the support frame includes detachable inward flanges which come into contact with the first and second storage tanks.

9. The simplified valuable mineral sorting apparatus according to claim 1, further comprising: a flow path tube which is connected at an end thereof to the second storage tank and at the other end thereof to the first storage tank so as to allowing the mixture in the second storage tank to be supplied to the first storage tank, wherein the flow path tube includes detachable caps provided at the opposite ends thereof so as to enable the flow path tube to be detachably coupled to the first and second storage tanks.

10. A method of sorting valuable minerals using the apparatus according to claim 1 comprising:

providing a mixture prepared by water and heavy powder into the first storage tank (S110);

providing a proper amount (about 100 g/ounce) of a clastic resource including crushed rock powder, sea sand or river sand into the sorting container (S115); and sorting one of a heavy mineral, a medium specific gravity mineral and a light mineral from the clastic resource in the sorting container by controlling a slope of the sorting container depending on a specific gravity of the mixture and a flow rate of the discharged mixture (S120).

11. The method according to claim 10, further comprising: supplying a portion of the mixture which exceeds a predetermined capacity level of the first storage container and resupplying the portion of the mixture to the first storage tank again by means of a lifting pump.

12. The method according to claim 11, wherein sorting the mineral (S120) comprises:

measuring a specific gravity of the mixture upon discharging the mixture from the first storage tank (S121);

measuring a flow rate of the discharged mixture (S122);

controlling a flow rate of the discharged mixture (S123); and sorting one of a heavy mineral, a medium specific gravity mineral and a light mineral from the mixture in the sorting container (S124).

* * * * *